US009136630B1

(12) United States Patent
Ju

(10) Patent No.: US 9,136,630 B1
(45) Date of Patent: Sep. 15, 2015

(54) ELECTRICAL CONNECTOR WITH SPHERICAL CONTACTS WITH AN ELASTIC MEMBER IN BETWEEN

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 6 days.

(21) Appl. No.: 14/290,474

(22) Filed: May 29, 2014

(30) Foreign Application Priority Data

Feb. 27, 2014 (CN) ..... 2014 2 0085761 U

(51) Int. Cl.

| | |
|---|---|
| ***H01R 3/08*** | (2006.01) |
| ***H01R 13/193*** | (2006.01) |
| ***H01R 13/03*** | (2006.01) |
| ***H01R 13/422*** | (2006.01) |

(52) U.S. Cl.
CPC ..... *H01R 13/193* (2013.01); *H01R 3/08* (2013.01); *H01R 13/03* (2013.01); *H01R 13/422* (2013.01)

(58) Field of Classification Search
CPC ..... H01R 4/00; H01R 4/04; H01R 3/08
USPC ..... 439/178–179, 65–66
See application file for complete search history.

(56) References Cited

U.S. PATENT DOCUMENTS

| | | | | |
|---|---|---|---|---|
| 6,464,511 | B1 * | 10/2002 | Watanabe et al. | 439/66 |
| 7,147,478 | B1 * | 12/2006 | Ju | 439/66 |
| 7,442,045 | B1 * | 10/2008 | Di Stefano | 439/66 |
| 7,458,818 | B2 * | 12/2008 | Kiyofuji et al. | 439/66 |
| 7,476,132 | B2 * | 1/2009 | Xu | 439/700 |
| 7,731,513 | B1 * | 6/2010 | Lin | 439/179 |
| 2006/0035483 | A1 * | 2/2006 | Rathburn et al. | 439/65 |

* cited by examiner

*Primary Examiner* — Chandrika Prasad
(74) *Attorney, Agent, or Firm* — Locke Lord LLP; Tim Tingkang Xia, Esq.

(57) ABSTRACT

An electrical connector for electrically connecting a first electronic element and a second electronic element, includes an insulating body having multiple receiving holes, a conducting assembly and an elastic member respectively received in each receiving hole, and an elastic member. The conducting assembly includes a first conductor, a second conductor and a third conductor electrically connected to the first conductor and the second conductor. The elastic member is used for elastically supporting the first conductor and the second conductor. One end of the first conductor is electrically conducted to the first electronic element, and one end of the second conductor is electrically conducted to the second electronic element. The conductor is spherical, which shortens the conducting path, lowers the height and impedance of the electrical connector, and improves the electrical performance. The elastic member can effectively avoid poor contact and instant disconnection.

34 Claims, 9 Drawing Sheets

ELECTRICAL CONNECTOR WITH SPHERICAL CONTACTS WITH AN ELASTIC MEMBER IN BETWEEN

CROSS-REFERENCE TO RELATED APPLICATION

This non-provisional application claims priority under 35 U.S.C. §119(a) on Patent Application No. 201420085761.7 filed in P.R. China on Feb. 27, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector for electrically connecting a first mating electronic element and a second mating electronic element.

BACKGROUND OF THE INVENTION

In the electronic industry, many electronic elements are interconnected through an electrical connector. Currently, an electrical connector generally adopted in the industry includes an insulating seat and an insulating cover that match with each other, and a first terminal, a second terminal and a compression spring assembled in a receiving hole of the insulating seat. The first and second terminals are respectively disposed at two ends of the compression spring, and contact ends thereof are respectively exposed out of the insulating seat and the insulating cover, for signal transmission at two ends of the first and second terminals.

However, the electrical connector still needs to be improved, that is, since the two ends of the compression spring indirectly urge against the first and second terminals, the current transmission fluctuates, which affects stability of signals in communication. Further, the first and second terminals are respectively disposed at the two ends of the compression spring, and to enable elastic extension and retraction of the spring, the receiving hole of the insulating seat for receiving the first terminal, the second terminal and the compression spring is generally made large. As a result, the contact of the first terminal and the second terminal is not tight, a forward force between the contact parts of the first terminal and the second terminal is small, and the contact impedance is large. Moreover, when an action force of the mating electronic element against the electrical connector is too large, the elastic extension and retraction directions change, so that the contact parts between the first and second terminals deviate, which affects electrical conduction between the electrical connector and the mating electronic element and further affects stability of signals in communication.

Therefore, a heretofore unaddressed need exists in the art to address the aforementioned deficiencies and inadequacies.

SUMMARY OF THE INVENTION

In one aspect, the present invention is directed to an electrical connector that has a low height and a small impedance, so as to improve stability of electrical connection and signal transmission between a chip module and the electrical connector.

In one embodiment, the electrical connector is used for electrically connecting a first electronic element and a second electronic element. The electrical connector includes an insulating body having multiple receiving holes, and a conducting assembly and an elastic member received in each receiving hole. The conducting assembly includes a first conductor, a second conductor, and a third conductor electrically connected to the first conductor and the second conductor. The elastic member is used for elastically supporting the first conductor and the second conductor. One end of the first conductor is electrically conducted to the first electronic element, and one end of the second conductor is electrically conducted to the second electronic element.

In one embodiment, the elastic member separates the first conductor from the second conductor.

In one embodiment, the first conductor and the second conductor are spherical.

In one embodiment, spherical centers of the first conductor and the second conductor are located on a same vertical line.

In one embodiment, the third conductor is a metal layer received in the receiving hole.

In one embodiment, the elastic member is a foaming material or rubber.

In one embodiment, the elastic member is spherical.

In one embodiment, a spherical center of the elastic member deviates from the vertical line.

In one embodiment, the elastic member generates an oblique thrust against the first conductor, so that the first conductor produces a contact force against the first electronic element and an inner wall of the receiving hole at the same time.

In one embodiment, the elastic member respectively generates an upward oblique thrust against the first conductor and a downward oblique thrust against the second conductor at the same time.

In one embodiment, the elastic member is capable of being buckled in the receiving hole.

In one embodiment, a through-hole is provided between two adjacent receiving holes, and a shielding conductor is provided on an inner wall of the through-hole.

In one embodiment, multiple shielding conductors enclose a pair of differential signals.

In one embodiment, the conducting assembly further includes a liquid conductor, and the liquid conductor is gallium or a gallium alloy received in the receiving hole.

In one embodiment, a material compatible with the liquid conductor is provided on a surface of the third conductor, and the material is tin or zinc.

In one embodiment, the first conductor includes a first vertical contact portion electrically connected to the first electronic element and a first lateral contact portion electrically connected to the third conductor, and the second conductor includes a second vertical contact portion electrically connected to the second electronic element and a second lateral contact portion electrically connected to the third conductor.

In one embodiment, the first vertical contact portion or the second vertical contact portion is provided with the gallium or gallium alloy.

In one embodiment, the first conductor is provided with a first urging portion urging against the elastic member, and the second conductor is provided with a second urging portion urging against the elastic member.

In one embodiment, the inner wall of the receiving hole has a certain slope.

In one embodiment, the liquid conductor is provided at least between two of the first conductor, the second conductor and the third conductor.

In one embodiment, a limiting block protrudes from a side wall of the receiving hole.

In another aspect, the invention is directed to an electrical connector for electrically connecting a first electronic element to a second electronic element.

In one embodiment, the electrical connector includes an insulating body having multiple receiving holes, at least one elastic member, at least one conducting assembly, and a first liquid metal. Each elastic member is correspondingly received in the receiving hole and has a receiving cavity. The at least one conducting assembly includes a first conductor and a second conductor received in the receiving cavity. The first liquid metal is provided between the first conductor and the second conductor.

In one embodiment, the elastic member includes a base and multiple protruding blocks extending from a surface of the base, the protruding blocks are received in the receiving hole, and the receiving cavity is disposed on the protruding blocks.

In one embodiment, the first conductor and the second conductor are both spherical.

In one embodiment, the protruding block is cylindrical.

In one embodiment, the first liquid metal is gallium or a gallium alloy.

In one embodiment, multiple protrusions are provided on a surface of the insulating body, and the base is provided with multiple via-holes matching with the protrusions.

In one embodiment, the protrusions are provided on a lower surface of the insulating body and do not exceed the bottom surface of the base in the protruding direction of the protrusions.

In one embodiment, the receiving cavity includes a first receiving space and a second receiving space, and a receiving passage in communication with the first receiving space and the second receiving space. The first conductor and the second conductor are respectively received in the first receiving space and the second receiving space. The first liquid metal is correspondingly received in the receiving passage and is electrically conducted to the first conductor and the second conductor.

In one embodiment, a third conductor is provided on an inner wall of the receiving hole.

In one embodiment, the second conductor is partially exposed out of the second receiving space, and is capable of being electrically conducted to the third conductor.

In one embodiment, the first conductor is capable of being partially exposed out of the first receiving space, and partially contacts the third conductor and is electrically connected to the second conductor.

In one embodiment, the elastic member is made of an insulating silicon gel material.

In one embodiment, a first support portion is provided in the first receiving space, the first support portion is capable of elastically supporting the first conductor, a second support portion is provided in the second receiving space, and the second support portion is capable of elastically supporting the second conductor.

In one embodiment, a first clamping portion is provided in the first receiving space, the first clamping portion is capable of being elastically urging against the first conductor, a second clamping portion is provided in the second receiving space, and the second clamping portion is capable of being elastically urging against the second conductor.

In one embodiment, the first support portion and the second support portion are capable of providing an oblique action force for the first conductor and the second conductor respectively, and the first clamping portion and the second clamping portion are capable of providing a horizontal action force for the first conductor and the second conductor respectively.

In one embodiment, the receiving cavity further includes a receiving slot provided on the periphery of the first receiving space, and the receiving slot is filled with a second liquid metal.

In one embodiment, the second liquid metal is gallium or a gallium alloy.

In one embodiment, the third conductor is capable of being electrically conducted to the second liquid metal.

Compared with the related art, certain embodiments of the present invention, among other things, have the following beneficial advantages.

The conductor is set to be spherical, which shortens the conducting path, lowers the height and impedance of the electrical connector, and improves the electrical performance. The elastic member can be disposed to effectively avoid poor contact and instant disconnection. The liquid metal conductor is disposed between the conductors, which further reduces the impedance and the occurrence of instant disconnection of the electrical connector and improves the electrical performance of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
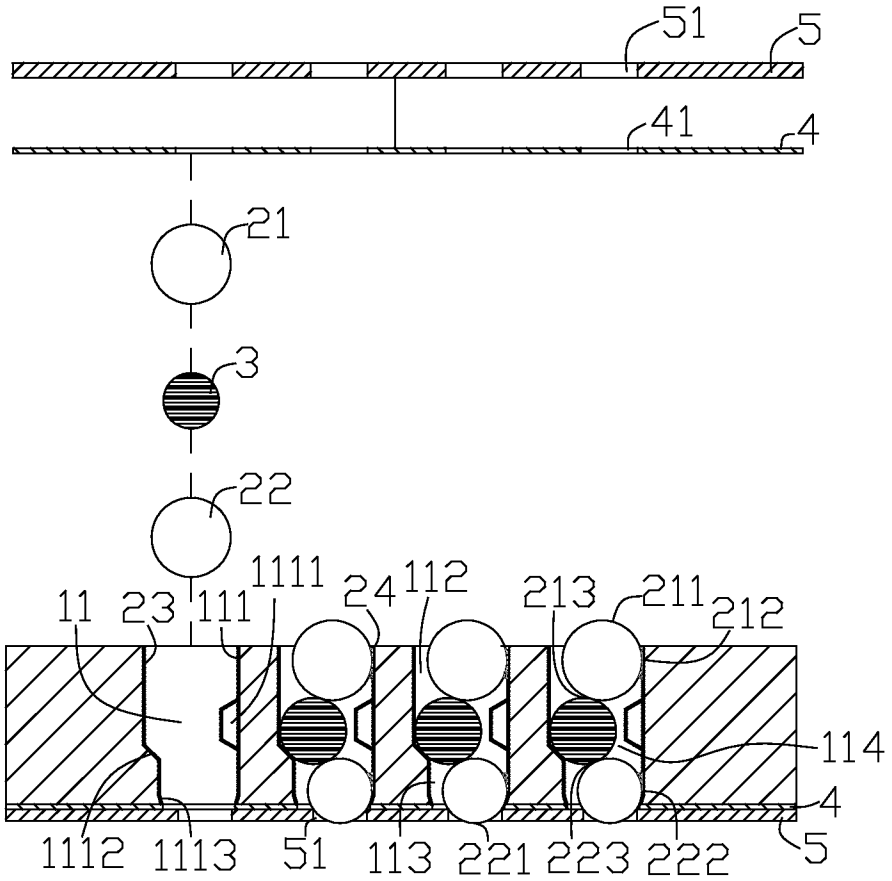
FIG. 1 is a schematic exploded view of a first embodiment of an electrical connector according to the invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to an electrical connector.

Figure 2:
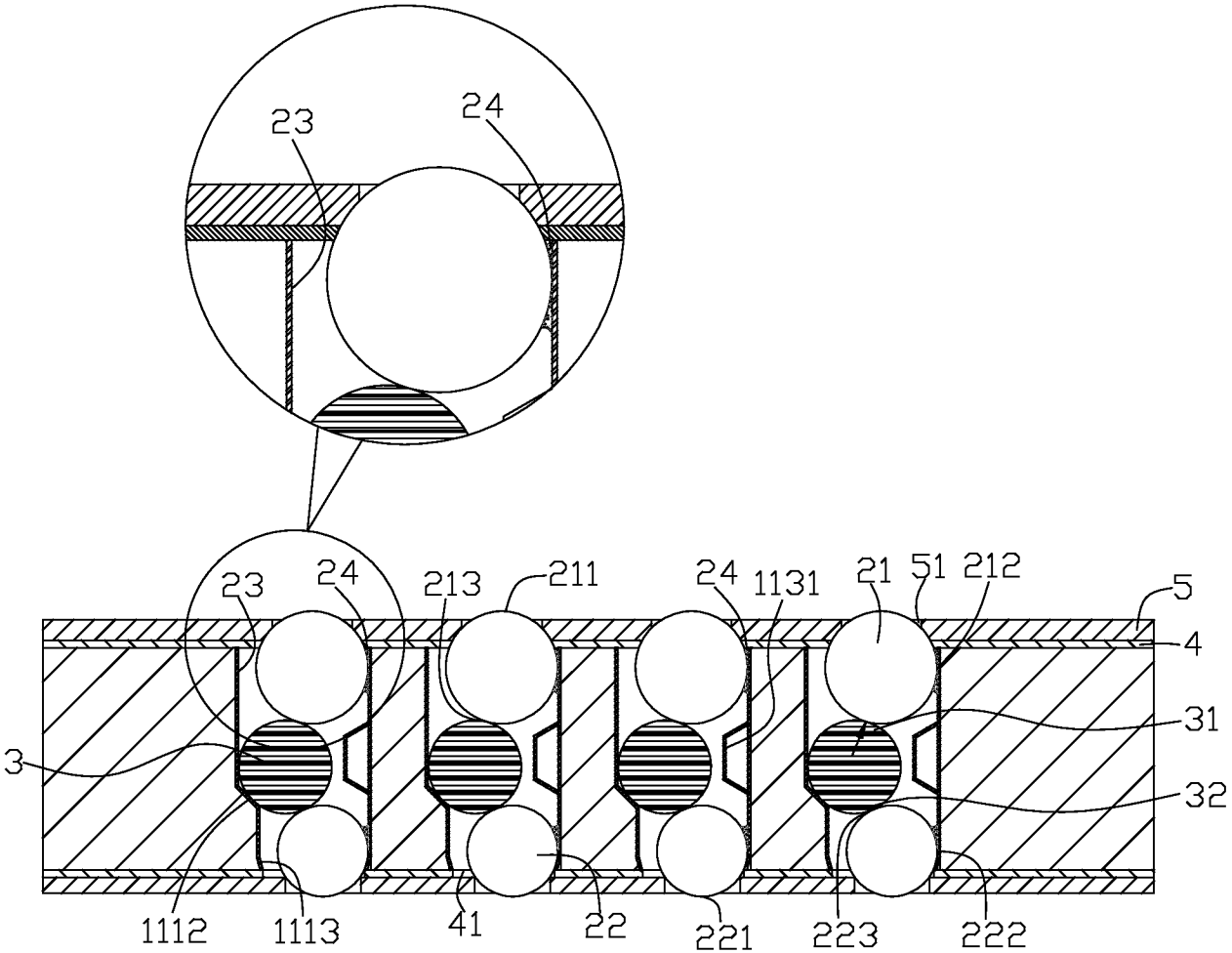
FIG. 2 is a schematic assembly view of the first embodiment of the electrical connector according to the invention.
Figure 5:
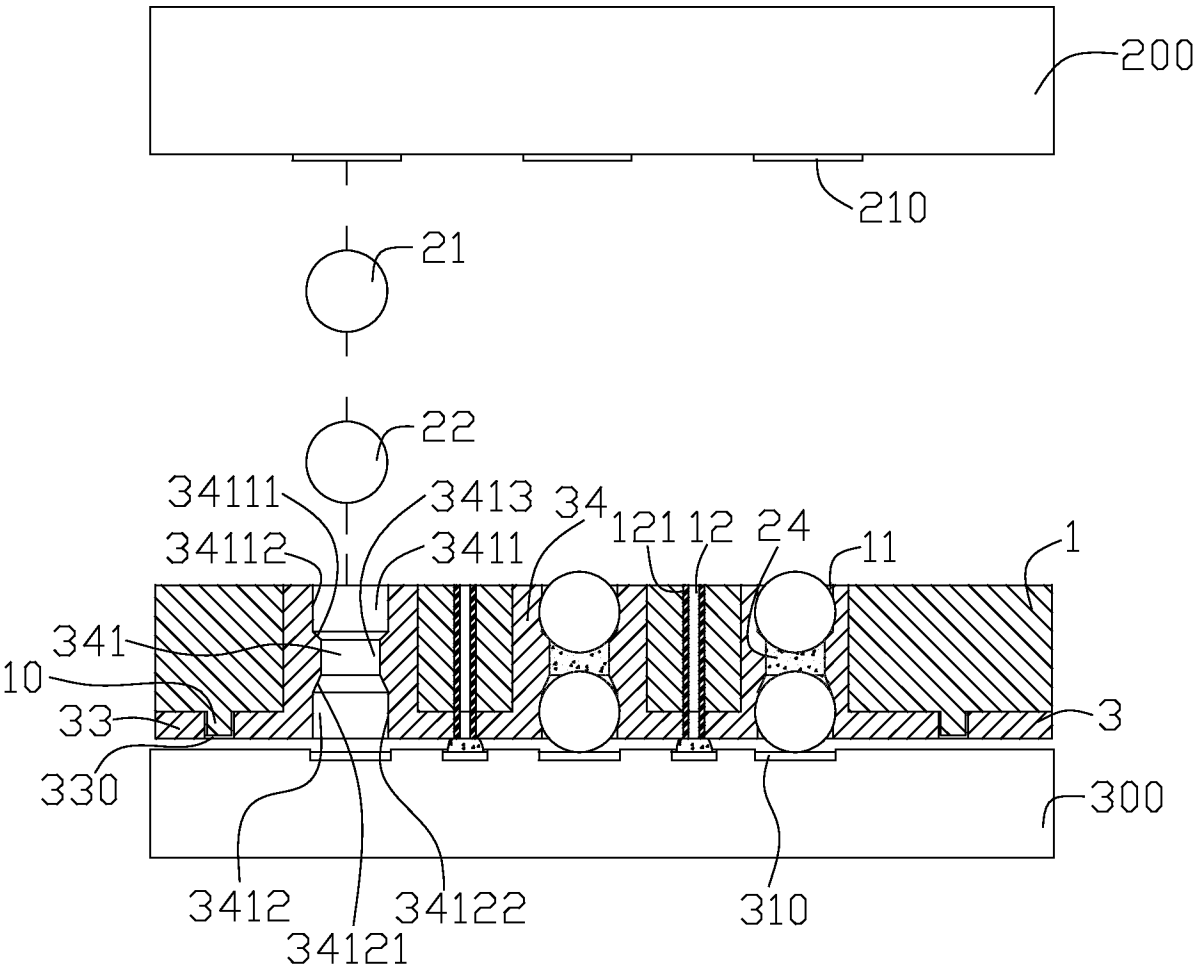
FIG. 5 is a schematic exploded view of a third embodiment of the electrical connector according to the invention.

Referring to FIGS. 1 and 2, as a first embodiment of an electrical connector according to the invention, the electrical connector is used for electrically connecting a chip module 200 and a circuit board 300 (please refer to FIG. 5). The chip module 200 has multiple first conducting portions 210, and the first conducting portion 210 may be a tin ball or copper pad. The circuit board 300 has multiple second conducting portions 310. The electrical connector includes an insulating body 1, multiple conducting assemblies and multiple elastic members 3. Each conducting assembly includes a first conductor 21, a second conductor 22, a third conductor 23, and a liquid metal conductor 24. The conducting assembly and the elastic member 3 are received in the insulating body 1.

The insulating body 1 is in the shape of a plate, and is made of plastic that is not easily deformed. The insulating body 1 includes receiving holes 11 for receiving the conducting assembly. The receiving hole 11 runs through an upper and a lower surface of the insulating body 1, and has a first opening formed on the upper surface of the insulating body 1 and a second opening formed on the lower surface of the insulating body 1. The size of the second opening is smaller than that of the first opening. An inner wall 111 of the receiving hole 11 extends from the first opening to the second opening. The extending direction of the inner wall 111 forms a certain angle with the vertical direction. A limiting block 1111 is provided at a center position of the inner wall 111. The limiting block 1111 protrudes from the inner wall 111 and extends toward the center of the receiving hole 11. Another side of the inner wall 111 relative to the limiting block 1111 extends toward the center of the receiving hole 11 to form a first support portion 1112. The first support portion 1112 is used for supporting the elastic member 3. The first support portion 1112 may be an inclined support surface or a cambered support surface. A second support portion 1113 is formed on the inner wall 111 near the second opening. The second support portion 1113 is used for supporting the second conductor 22. The second support portion 1113 may be an inclined support surface or a cambered support surface. The receiving hole 11 is divided by the limiting block 1111 into a first receiving cavity 112 and a second receiving cavity 113, and a third receiving cavity 114 in communication with the first receiving cavity 112 and the second receiving cavity 113.

The conducting assembly includes the first conductor 21, the second conductor 22, the third conductor 23, and the liquid metal conductor 24. The first conductor 21 and the second conductor 22 are spherical and are respectively received in the first receiving cavity 112 and the second receiving cavity 113, and spherical centers of the first conductor 21 and the second conductor 22 are located on a same vertical line. The first conductor 21 includes a first vertical contact portion 211 electrically connected to the chip module 200, a first lateral contact portion 212 electrically connected to the third conductor 23, and a first urging portion 213 urging against the elastic member 3. The second conductor 22 includes a second vertical contact portion 221 electrically connected to the circuit board 300, a second lateral contact portion 222 electrically connected to the third conductor 23, and a second urging portion 223 urging against the elastic member 3. The liquid metal conductor 24 is provided on the first vertical contact portion 211 and the second vertical contact portion 221 and is electrically conducted to the chip module 200 and the circuit board 300, to reduce the impedance and the occurrence of instant disconnection of the electrical connector and improve the electrical performance of the electrical connector. The third conductor 23 is a metal layer provided in the inner wall 111, a material (not shown) compatible with the liquid metal conductor 24 is provided on a surface of the third conductor 23, and in one embodiment, the material is zinc or tin. The material compatible with the liquid metal conductor 24 is provided on the surface of the third conductor 23, which improves fluidity of the liquid metal conductor 24 and provides better electrical performance.

The liquid metal conductor 24 is gallium or a gallium alloy, and the gallium alloy is a gallium-tin alloy or a gallium-indium alloy or a gallium-indium-tin alloy. Since the melting point of gallium is about 29.76° C., the liquid metal conductor 24 can use the gallium directly. The melting point of indium is about 156.61° C., and the melting point of tin is about 231.93° C., but the melting point of a binary or ternary alloy of indium, gallium, and tin can be greatly lowered, and the melting points of the above alloys change according to different proportions. For example, when an indium-gallium proportion is 24.5:75.5, the melting point of an indium-gallium binary alloy is 15.7° C., and when an indium-gallium-tin proportion is 20.5:66.5:13.0, the melting point of an indium-gallium-tin ternary alloy is 10.7° C. Therefore, the liquid metal conductor 24 may also be any one of indium-gallium, gallium-tin, and indium-gallium-tin alloys. A user can use gallium, or use an alloy of indium, gallium, and tin prepared according to a proportion, so that at a normal temperature or a room temperature, the gallium or gallium alloy is in a liquid form. Therefore, the contact area between the conductors is large, the impedance is small, and energy may not be consumed due to impedance during current transmission, which ensures stability of the current transmission and achieves good electrical connection effect.

The elastic member 3 is spherical and is received in the third receiving cavity 114. One side of the elastic member 3 is urged against the first support portion 1112, another side of the elastic member 3 is stopped by the limiting block 1111, and the limiting block 1111 prevents the elastic member 3 from moving around, which improves stability of the structure of the electrical connector. The elastic member 3 includes a first elastic portion 31 and a second elastic portion 32 that elastically support and separate the first conductor 21 and the second conductor 22. The first elastic portion 31 is elastically urging against the first urging portion 213, and the second elastic portion 32 is elastically urging against the second urging portion 223. The elastic member 3 is made of a foaming material or a rubber material, and a spherical center of the elastic member 3 deviates from the vertical line. When the first conductor 21 is connected to the chip module 200, under a downward pressing force applied by the chip module 200, the first conductor 21 moves downward, slidably and obliquely contacts the elastic member 3 and presses against the first elastic portion 31, and is also urging against and conducted to the third conductor 23. The first elastic portion 31 retracts and applies an obliquely urging force against the first conductor 21. When the second conductor 22 is connected to the circuit board 300, under an upward pressing force applied by the circuit board 300, the second conductor 22 moves upward, slidably and obliquely contacts the elastic member 3 and presses against the second elastic portion 32, and is also urging against and conducted to the third conductor 23. The second elastic portion 32 retracts and applies an obliquely urging force against the second conductor 22. The elastic member 3 is made of a foaming material or silicon gel material, and has good retracting performance.

At least one mylar 4 and at least one cover plate 5 are sequentially provided on a surface of the insulating body 1. The mylar 4 has first holes 41 corresponding to the receiving holes 11, the cover plate 5 has second holes 51 corresponding to the receiving holes 11, and the sizes of the first hole 41 and the second hole 51 are smaller than the sizes of the first conductor 21 and the second conductor 22 respectively, which prevents the first conductor 21 and the second conductor 22 from escaping from the receiving hole 11.

When the electrical connector is electrically connected to the chip module 200 and the circuit board 300, the first conductor 21 and the second conductor 22 are electrically connected to the chip module 200 and the circuit board 300 respectively. Specifically, the elastic member 3 generates an obliquely urging force against the first conductor 21, so that the first lateral contact portion 212 of the first conductor 21 generates a horizontal forward pressing force against the third conductor 23. The elastic member 3 generates an obliquely urging force against the second conductor 22, so that the second lateral contact portion 222 of the second conductor 22 generates a horizontal forward pressing force against the third conductor 23. The liquid metal conductor 24 may also be coated on the surface of the third conductor 23, and is electrically conducted to the first lateral contact portion 212 and the second lateral contact portion 222, to further lower the impedance and the occurrence of instant disconnection of the electrical connector and improve the electrical performance of the electrical connector.

Figure 3:
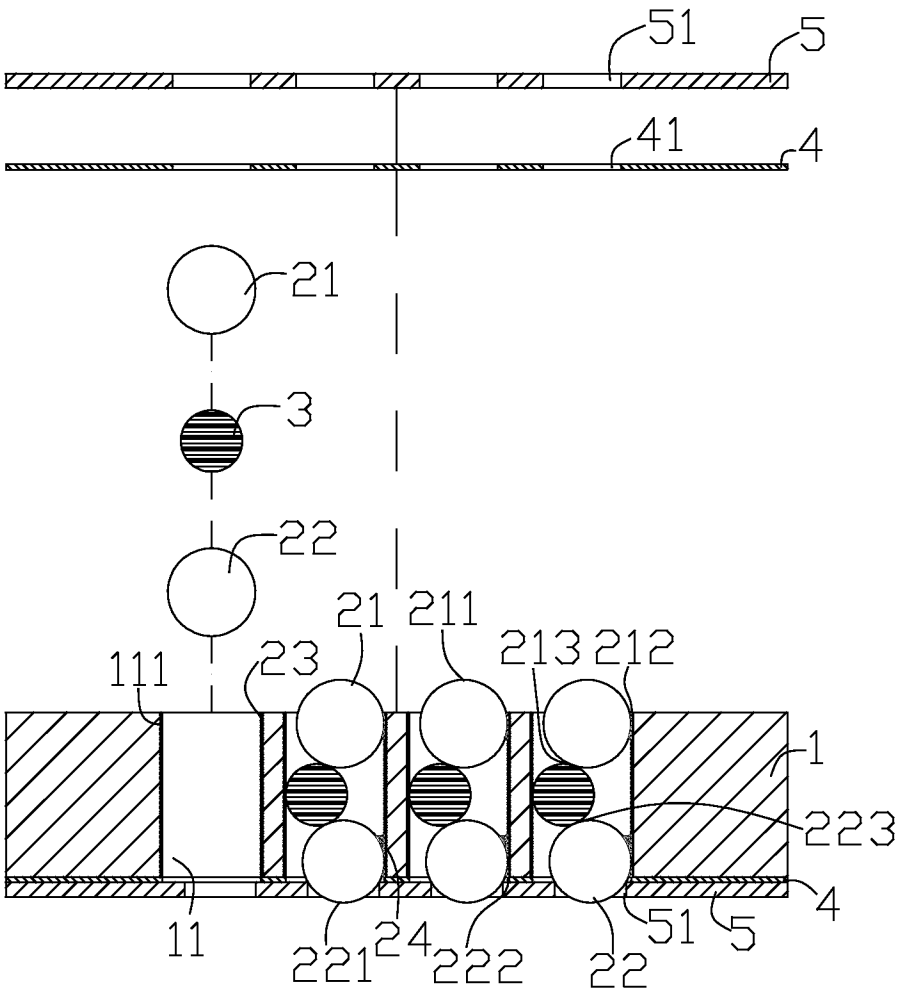
FIG. 3 is a schematic exploded view of a second embodiment of the electrical connector according to the invention.
Figure 4:
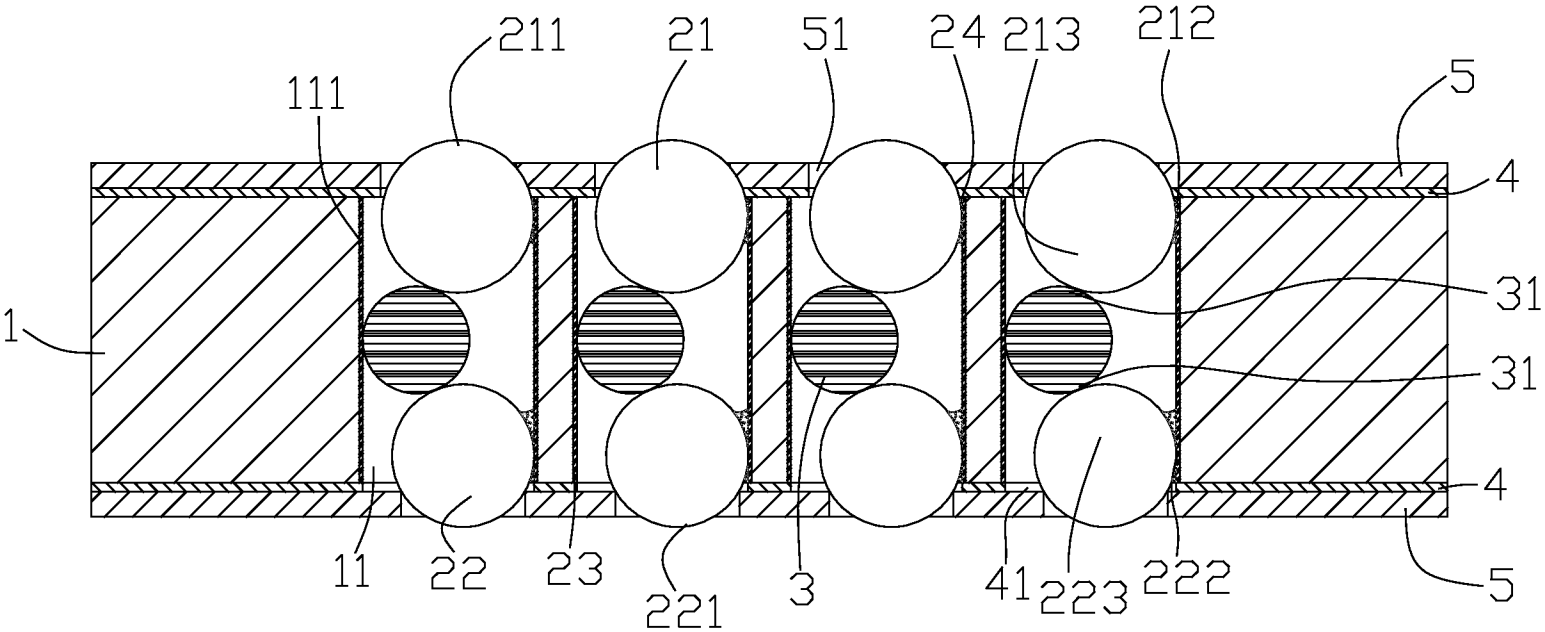
FIG. 4 is a schematic assembly view of the second embodiment of the electrical connector according to the invention.

Referring to FIG. 3 and FIG. 4, as a second embodiment of the invention, the difference between the electrical connector in the second embodiment and the electrical connector in the first embodiment lies in that, the receiving hole 11 vertically passes through the insulating body 1, the conducting assembly is received in the receiving hole 11, and the mylar 4 and the cover plate 5 are sequentially provided on the surface of the insulating body 1. The mylar 4 has the first hole 41 corresponding to the receiving hole 11, the cover plate 5 has the second hole 51 corresponding to the receiving hole 11, and the sizes of the first hole 41 and the second hole 51 are smaller than the sizes of the first conductor 21 and the second conductor 22, which prevents the first conductor 21 and the second conductor 22 from escaping from the receiving hole 11. The first vertical contact portion 211 of the first conductor 21 partially protrudes from the mylar 4 and the cover plate 5 and is electrically conducted to the chip module 200, and the second vertical contact portion 221 of the second conductor 22 partially protrudes from the mylar 4 and the cover plate 5 and is electrically conducted to the circuit board 300. This embodiment can also achieve the objective and the technical effect of the first embodiment, and the details will not be repeated herein.

Figure 6:
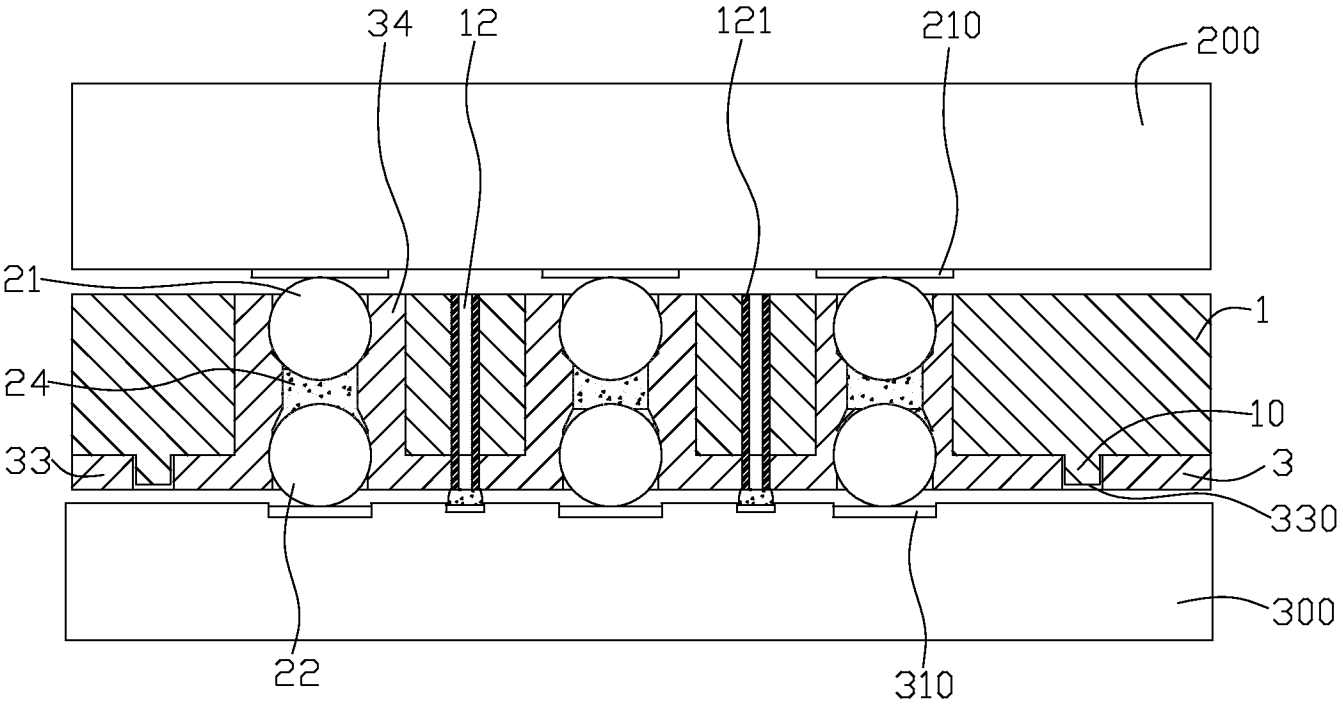
FIG. 6 is a schematic assembly view of the third embodiment of the electrical connector according to the invention.

Referring to FIG. 5 and FIG. 6, as a third embodiment of the electrical connector according to the invention, the electrical connector is used for electrically connecting a chip module 200 and a circuit board 300. The chip module 200 has multiple first conducting portions 210, the first conducting portions 210 may be a tin ball or copper pad, the circuit board 300 has multiple second conducting portions 310, and the electrical connector includes an insulating body 1, multiple conducting assemblies and multiple elastic members 3. Each conducting assembly includes a first conductor 21, a second conductor 22 and a liquid metal conductor 24, and the conducting assembly and the elastic member 3 are received in the insulating body 1.

The insulating body 1 is in the shape of a plate, and is made of plastic that is not easily deformed. The insulating body 1 has a receiving hole 11 for receiving the elastic member 3, and multiple protrusions 10 are provided on a lower surface of the insulating body 1. Referring to FIG. 5, a through-hole 12 is provided between two adjacent receiving holes 11. A shielding conductor 121 is provided on an inner wall of the through-hole 12. The shielding conductor 121 is a shielding plating layer, and multiple shielding conductors 121 enclose a pair of differential signals, which enhances stability of signal transmission of the electrical connector. The first conductor 21 and the second conductor 22 are spherical, and the first conductor 21 forms a conducting path with the second conductor 22 through the liquid metal conductor 24, that is, the conducting assembly is formed. The liquid metal conductor 24 is gallium or a gallium alloy, and the gallium alloy is a gallium-tin alloy or a gallium-indium alloy or a gallium-indium-tin alloy. Since the melting point of gallium is about 29.76° C., the liquid metal conductor 24 can use the gallium directly. The melting point of indium is about 156.61° C., and the melting point of tin is about 231.93° C., but the melting point of a binary or ternary alloy of indium, gallium, and tin can be greatly lowered, and the melting points of the above alloys change according to different proportions. For example, when an indium-gallium proportion is 24.5:75.5, the melting point of an indium-gallium binary alloy is 15.7° C., and when an indium-gallium-tin proportion is 20.5:66.5:13.0, the melting point of an indium-gallium-tin ternary alloy is 10.7° C. Therefore, the liquid metal conductor 24 may also be any one of indium-gallium, gallium-tin, and indium-gallium-tin alloys. A user can use gallium, or use an alloy of indium, gallium, and tin prepared according to a proportion, so that at a normal temperature or a room temperature, the gallium or gallium alloy is in a liquid form. Therefore, the contact area between the conductors is large, the impedance is small, and energy may not be consumed due to impedance during current transmission, which ensures stability of the current transmission and achieves good electrical connection effect.

The elastic member 3 includes a base 33 and multiple protruding blocks 34 extending from a surface of the base 33. Each protruding block 34 is provided with a receiving cavity 341, and the receiving cavity 341 can be used for receiving the conducting assembly. The protruding block 34 is cylindrical, and the protruding block 34 can be correspondingly received in the receiving hole 11. The base 33 is provided with multiple via-holes 330 corresponding to the protrusions 10, and the protrusions 10 do not exceed the bottom surface of the base 33 in the protruding direction of the protrusions 10. When the chip module 200 presses downwardly the insulating body 1, and the insulating body 1 subsequently presses downwardly the circuit board 300, a counter force from the circuit board 300 is generated upwardly against the base 33, which causes compression and deformation of the base 33. Under this situation, the protrusions 10 prevent excessive crush of the base 33 by the circuit board 300. The receiving cavity 341 includes a first receiving space 3411 and a second receiving space 3412, and a receiving passage 3413 in communication with the first receiving space 3411 and the second receiving space 3412. The first conductor 21 and the second conductor 22 are respectively received in the first receiving space 3411 and the second receiving space 3412, and the liquid metal conductor 24 is correspondingly received in the receiving passage 3413 and is electrically conducted to the first conductor 21 and the second conductor 22. The first receiving space 3411 is provided with a first support portion 34111, and the first support portion 34111 can elastically support the first conductor 21. The second receiving space 3412 is provided with a second support portion 34121, and the second support portion 34121 can elastically support the second conductor 22. The first receiving space 3411 is provided with a first clamping portion 34112, and the first clamping portion 34112 can be elastically urged against the first conductor 21. The second receiving space 3412 is provided with a second clamping portion 34122, and the second clamping portion 34122 can be elastically urged against the second conductor 22. The first support portion 34111 and the second support portion 34121 can respectively apply oblique action forces on the first conductor 21 and the second conductor 22, and the first clamping portion 34112 and the second clamping portion 34122 can respectively apply horizontal action forces on the first conductor 21 and the second conductor 22. The elastic member 3 is made of a foaming material or silicon gel material, and has good retracting performance.

When the electrical connector is electrically connected to the chip module 200 and the circuit board 300, the first conductor 21 and the second conductor 22 are electrically connected to the chip module 200 and the circuit board 300 respectively. Specifically, when the chip module 200 is urged against the insulating body 1, the first conducting portion 210 is conducted to the first conductor 21 in the first receiving space 3411, the first conductor 21 contacts the second conductor 22 in the second receiving space 3412 through the liquid metal conductor 24 in the receiving passage 3413, and the second conductor 22 is further conducted to the second conducting portion 310, to form a complete conducting path, thereby achieving electrical connection between the chip module 200 and the circuit board 300.

Figure 7:
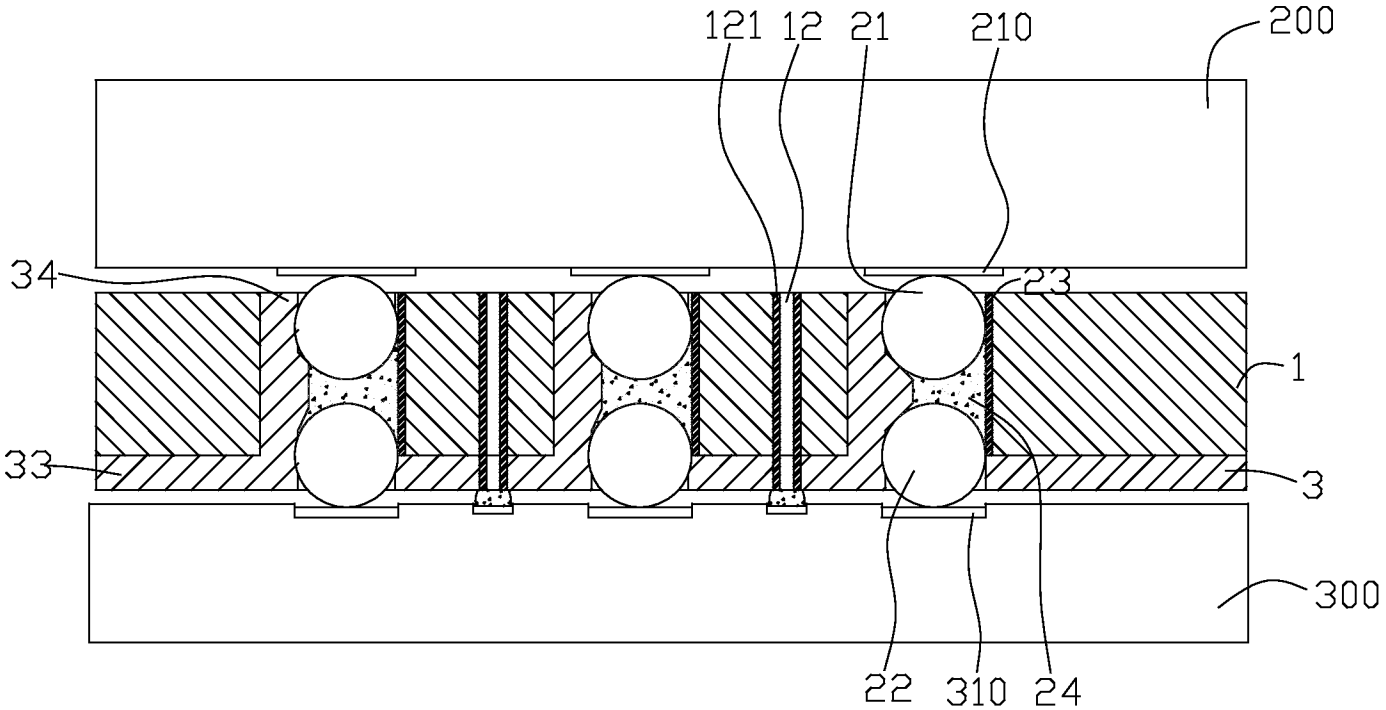
FIG. 7 is a schematic assembly view of a fourth embodiment of the electrical connector according to the invention.

Referring to FIG. 7, as a fourth embodiment of the invention, the difference between the electrical connector in the fourth embodiment and the electrical connector in the third embodiment lies in that, a third conductor 23 is provided on an inner wall 111 of the receiving hole 11, a lateral space (not shown) of the receiving cavity 341 of the protruding block 34 is exposed out of an outer surface of the protruding block 34, and the first conductor 21 and the second conductor 22 in the elastic member 3 can be partially exposed out of the lateral space (not shown) and are conducted to the third conductor 23. In this manner, two conducting paths from the first conductor 21 to the liquid metal conductor 24 and then to the second conductor 22 and from the first conductor 21 to the third conductor 23 and then to the second conductor 22 can be formed, which further improves stability of signal transmission of the electrical connector. This embodiment can also achieve the objective and the technical effect of the third embodiment, and the details will not be repeated herein.

Figure 8:
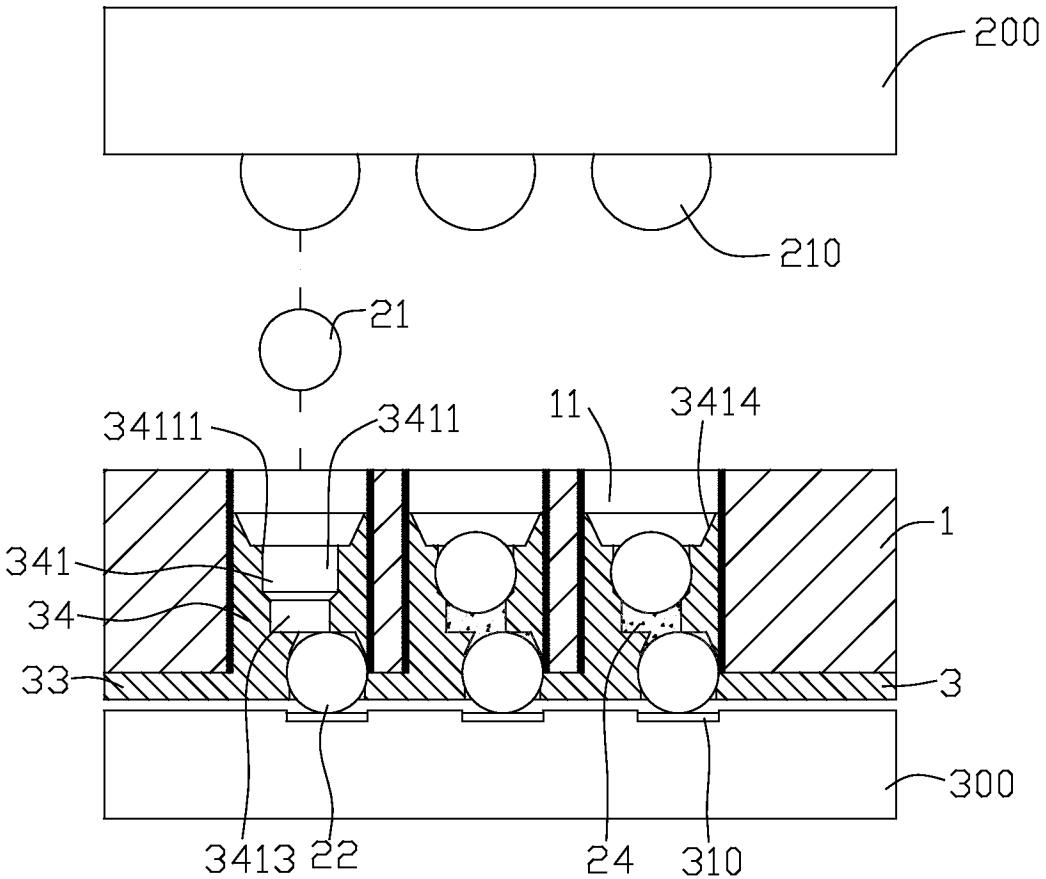
FIG. 8 is a schematic exploded view of a fifth embodiment of the electrical connector according to the invention.
Figure 9:
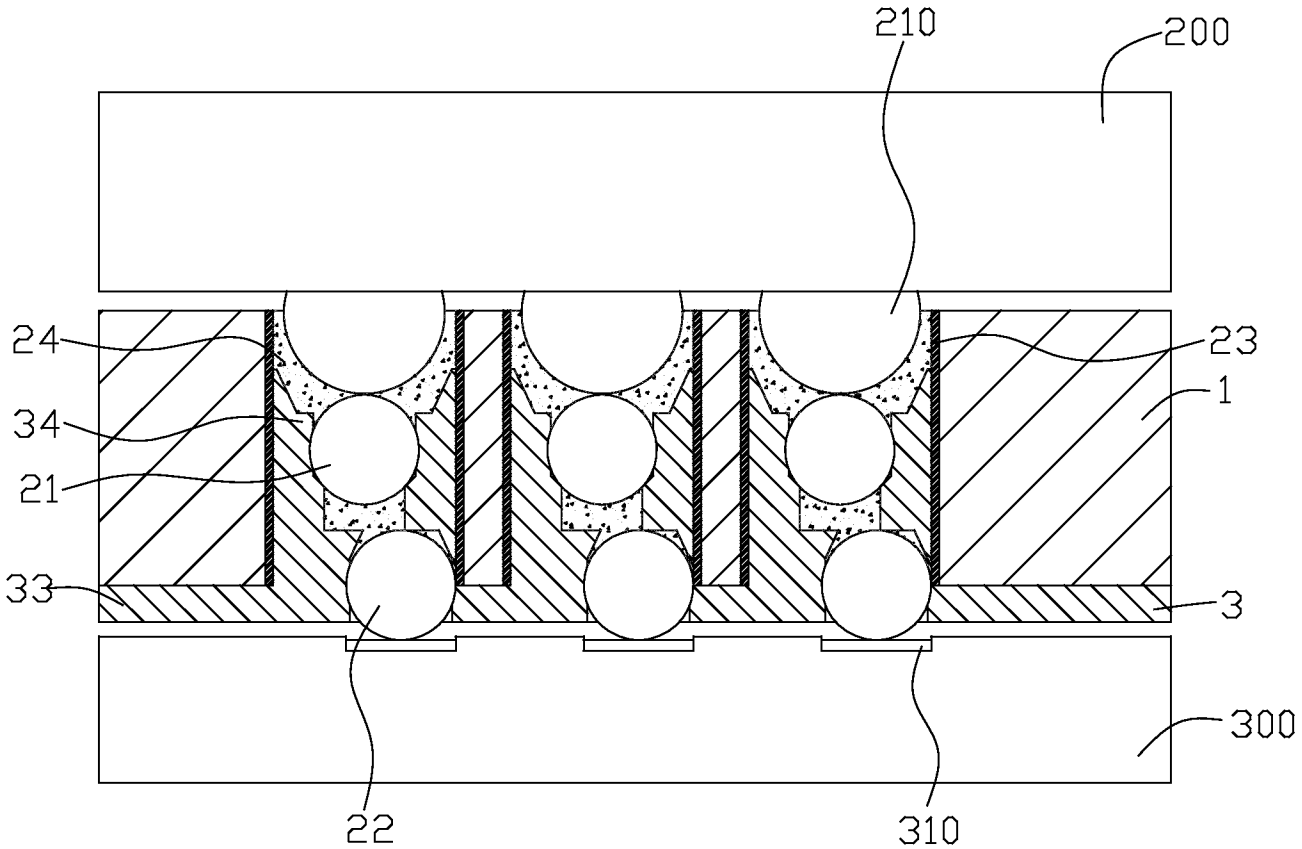
FIG. 9 is a schematic assembly view of the fifth embodiment of the electrical connector according to the invention.

Referring to FIG. 8 and FIG. 9, as a fifth embodiment of the invention, the difference between the electrical connector in the fifth embodiment and the electrical connector in the third embodiment lies in that: a third conductor 23, which is a metal layer, is provided on an inner wall 111 of the receiving hole 11; the height of the protruding block 34 is less than the height of the insulating body 1; the receiving cavity 341 further includes a receiving slot 3414 disposed above the first receiving cavity 3411 and having an expanded dimension greater than that of the first receiving cavity 3411, the liquid metal conductor 24 fills the receiving cavity 341 including the receiving slot 3414, and flows over the top of the protruding blocks 34, so as to electrically conduct the third conductor 23; the first receiving cavity 3411 and the second receiving cavity 3412 are partially staggered in the vertical direction, and the spherical centers of the first conductor 21 and the second conductor 22 locate at different vertical lines, so as to further decrease the overall height of the electrical connector. The second conductor 22 conducts the third conductor 23.

In this embodiment, when the chip module 200 urges against the insulating body 1, the first conducting portion 210, i.e., the tin balls, enters the receiving slot 3414 and contact with the first conductor 21 disposed in the first receiving cavity 3411, the first conducting portion 210 can also respectively conduct the first conductor 21 and the third conductor 23 through the liquid metal conductor 24, the first conductor 21 can conduct the second conductor 22 disposed in the second receiving cavity 3412 through the liquid metal conductor 24 disposed in the receiving passage 3413, the first conductor 21 can also conduct the second conductor 22 through the third conductor 23, the second conductor 22 further conducts the second conducting portion 310, thus forms several complete conducting paths, and achieves electrical connection between the chip module 200 and the circuit board 300.

In view of the above, the electrical connector according to certain embodiments of the present invention, among other things, has the following beneficial advantages.

(1) The conductor is set to be spherical, which shortens the conducting path, lowers the height and impedance of the electrical connector, and improves the electrical performance.

(2) The elastic member 3 can be set to effectively avoid poor contact and instant disconnection.

(3) The liquid metal conductor 24 is set between the conductors, which further reduces the impedance and the occurrence of instant disconnection of the electrical connector, and improves the electrical performance of the electrical connector.

(4) The limiting block 1111 is provided on the inner wall 111, which prevents the elastic member 3 from moving around, and improves stability of the structure of the electrical connector.

(5) The material compatible with the liquid metal conductor 24 is provided on the surface of the third conductor 23, which improves fluidity of the liquid metal conductor 24.

(6) A through-hole 12 is provided between two adjacent receiving holes 11, a shielding conductor 121 is provided on an inner wall of the through-hole 12, and multiple shielding conductors 121 enclose a pair of differential signals, which enhances stability of signal transmission of the electrical connector.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for electrically connecting a first electronic element and a second electronic element, comprising:

an insulating body having a plurality of receiving holes, each receiving hole receiving a conducting assembly and an elastic member, wherein the conducting assembly comprises a first conductor, a second conductor, and a third conductor electrically connected to the first conductor and the second conductor;

wherein the elastic member is used for elastically supporting the first conductor and the second conductor; and wherein one end of the first conductor is electrically conducted to the first electronic element, and one end of the second conductor is electrically conducted to the second electronic element, wherein the first conductor, the second conductor and the elastic member are spherical, spherical centers of the first conductor and the second conductor are located on a same line and the center of the elastic member deviates from the same line.

2. The electrical connector according to claim 1, wherein the elastic member separates the first conductor from the second conductor.

3. The electrical connector according to claim 1, wherein the third conductor is a metal layer received in the receiving hole.

4. The electrical connector according to claim 1, wherein the elastic member is a foaming material or rubber.

5. The electrical connector according to claim 1, wherein the elastic member generates an oblique thrust against the first conductor, so that the first conductor produces a contact force against the first electronic element and an inner wall of the receiving hole at the same time.

6. The electrical connector according to claim 1, wherein the elastic member respectively generates an upward oblique thrust against the first conductor and a downward oblique thrust against the second conductor at the same time.

7. The electrical connector according to claim 1, wherein the elastic member is buckled in the receiving hole.

8. The electrical connector according to claim 1, wherein a through-hole is provided between two adjacent receiving holes, and a shielding conductor is provided on an inner wall of the through-hole.

9. The electrical connector according to claim 8, wherein multiple shielding conductors enclose a pair of differential signals.

10. The electrical connector according to claim 1, wherein the conducting assembly further comprises a liquid conductor, and the liquid conductor is gallium or a gallium alloy received in the receiving hole.

11. The electrical connector according to claim 10, wherein a material compatible with the liquid conductor is provided on a surface of the third conductor, and the material is tin or zinc.

12. The electrical connector according to claim 10, wherein the liquid conductor is provided at least between two of the first conductor, the second conductor and the third conductor.

13. The electrical connector according to claim 1, wherein the first conductor comprises a first vertical contact portion electrically connected to the first electronic element and a first lateral contact portion electrically connected to the third conductor, and the second conductor comprises a second vertical contact portion electrically connected to the second electronic element and a second lateral contact portion electrically connected to the third conductor.

14. The electrical connector according to claim 13, wherein the first vertical contact portion or the second vertical contact portion is provided with gallium or gallium alloy.

15. The electrical connector according to claim 1, wherein the first conductor is provided with a first urging portion urging against the elastic member, and the second conductor is provided with a second urging portion urging against the elastic member.

16. The electrical connector according to claim 1, wherein an inner wall of the receiving hole has a slope.

17. The electrical connector according to claim 1, wherein a limiting block protrudes from a side wall of the receiving hole.

18. An electrical connector for electrically connecting a first electronic element to a second electronic element, comprising:

an insulating body having a plurality of receiving holes;

at least one elastic member, each elastic member being correspondingly received in the receiving hole and provided with a receiving cavity; and at least one conducting assembly, each comprising a first conductor and a second conductor received in the corresponding receiving cavity, and a first liquid metal provided between the first conductor and the second conductor, wherein the first conductor and the second conductor are both spherical, and a third conductor is provided on an inner wall of the receiving hole.

19. The electrical connector according to claim 18, wherein the elastic member comprises a base and a plurality of protruding blocks extending from a surface of the base, the protruding blocks are received in the receiving hole, and the receiving cavity is disposed on the protruding blocks.

20. The electrical connector according to claim 19, wherein the protruding block is cylindrical.

21. The electrical connector according to claim 19, wherein multiple protrusions are provided on a surface of the insulating body, and the base is provided with multiple via-holes matching with the protrusions.

22. The electrical connector according to claim 21, wherein the protrusions are provided on a lower surface of the insulating body and do not exceed the bottom surface of the base in the protruding direction of the protrusions.

23. The electrical connector according to claim 18, wherein the first liquid metal is gallium or a gallium alloy.

24. The electrical connector according to claim 18, wherein the elastic member is made of an insulating silicon gel material.

25. The electrical connector according to claim 21, wherein the receiving cavity comprises a first receiving space, a second receiving space, and a receiving passage in communication with the first receiving space and the second receiving space;

wherein the first conductor and the second conductor are respectively received in the first receiving space and the second receiving space; and wherein the first liquid metal is correspondingly received in the receiving passage and is electrically conducted to the first conductor and the second conductor.

26. The electrical connector according to claim 25, wherein the second conductor is partially exposed out of the second receiving space, and is electrically conducted to the third conductor.

27. The electrical connector according to claim 25, wherein the first conductor is partially exposed out of the first receiving space, partially contacts the third conductor, and electrically connected to the second conductor.

28. The electrical connector according to claim 25, wherein a first support portion is provided in the first receiving space, the first support portion elastically supporting the first conductor, a second support portion is provided in the second receiving space, and the second support portion elastically supporting the second conductor.

29. The electrical connector according to claim 28, wherein the first support portion and the second support portion provide an oblique action force for the first conductor and the second conductor respectively.

30. The electrical connector according to claim 25, wherein a first clamping portion is provided in the first receiving space, the first clamping portion elastically urging against the first conductor, a second clamping portion is provided in the second receiving space, and the second clamping portion elastically urging against the second conductor.

31. The electrical connector according to claim 30, wherein the first clamping portion and the second clamping portion provide a horizontal action force for the first conductor and the second conductor respectively.

32. The electrical connector according to claim 25, wherein the receiving cavity further comprises a receiving slot provided on the periphery of the first receiving space, and the receiving slot is filled with a second liquid metal.

33. The electrical connector according to claim 32, wherein the second liquid metal is gallium or a gallium alloy.

34. The electrical connector according to claim 33, wherein the third conductor is electrically conducted to the second liquid metal.

* * * * *